United States Patent [19]

Palmquist et al.

[11] Patent Number: 4,755,004

[45] Date of Patent: Jul. 5, 1988

[54] ROTARY ROCKSAW DEVICE

[76] Inventors: Roger A. Palmquist, 2914 Wroxton; Jesse W. Harris, 3006 Mayfair, both of San Antonio, Tex. 78217

[21] Appl. No.: 930,513

[22] Filed: Nov. 14, 1986

[51] Int. Cl.[4] ..... E21C 25/12; E02F 5/08

[52] U.S. Cl. ..... 299/91; 299/39

[58] Field of Search ..... 299/39, 84, 91, 92, 299/93, 86; 37/189, 191 R, DIG. 87, 80 A, 94, 141 T, 142 R; 125/15

[56] References Cited

U.S. PATENT DOCUMENTS

| | | | |
|---|---|---|---|
| Re. 28,310 | 1/1975 | Krekeler | 299/93 |
| 322,567 | 7/1885 | Stonesifer | 172/544 |
| 2,083,834 | 6/1937 | Galuppo et al. | 299/56 |
| 2,710,179 | 6/1955 | Cartlidge | 299/89 |
| 2,934,841 | 5/1960 | Tibbits, Jr. | 37/94 |
| 3,101,932 | 8/1963 | Wright | 299/39 |
| 3,279,856 | 10/1966 | Silks | 299/85 |
| 3,290,096 | 12/1966 | Stalker | 299/78 |
| 3,364,602 | 1/1968 | Renzaglia | 37/94 |
| 3,519,309 | 7/1970 | Engle et al. | 299/86 |
| 3,663,063 | 5/1972 | Johnmeyer, Sr. | 299/89 X |
| 3,680,919 | 8/1972 | Rear et al. | 299/39 |
| 3,967,854 | 7/1976 | Posciri | 37/189 X |
| 4,068,897 | 1/1978 | Amoroso | 299/91 |
| 4,512,612 | 4/1985 | Allard | 299/91 |
| 4,640,551 | 2/1987 | Marten | 299/1 |

*Primary Examiner*—Stephen J. Novosad
*Assistant Examiner*—David J. Bagnell
*Attorney, Agent, or Firm*—Burns, Doane, Swecker & Mathis

[57] ABSTRACT

A rocksaw device for trenching through hard rock or rocky soil comprising a disc having a mounting base positioned therearound. The mounting base may comprise a plurality of base sections each formed in the shape of a section of a toroid generated by a planar closed curve rotated around the disc axis. The closed curve which generates the toroid is curved along a side opposite the disc axis to provide a convex mounting surface across a mounting surface width in a direction parallel to the disc axis to enable teeth to be mounted at a constant slant angle while maintaining full coverage of the trench area to be cut. An arrangement in which the teeth can be positioned on the bases and a tooth assembly structure usable with the rocksaw are also disclosed.

16 Claims, 5 Drawing Sheets

Fig. 1
PRIOR ART
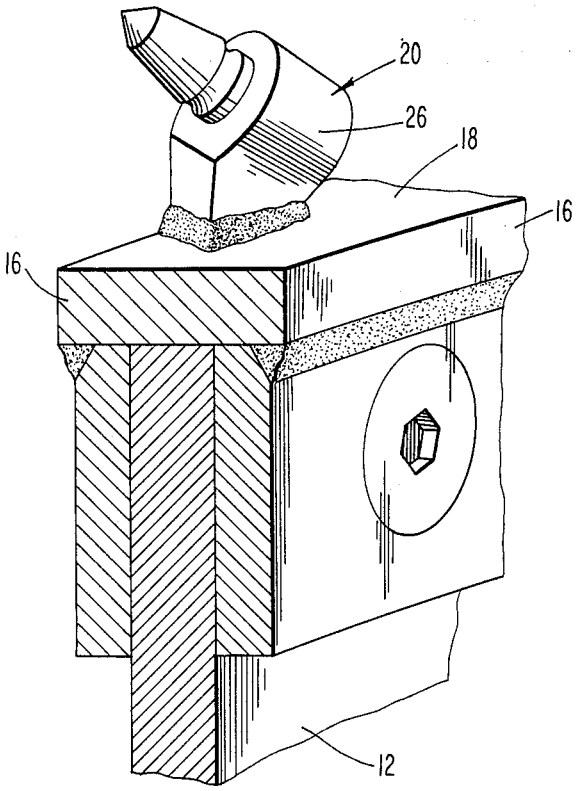
Fig. 2
PRIOR ART
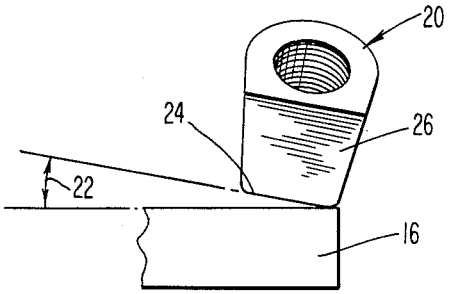
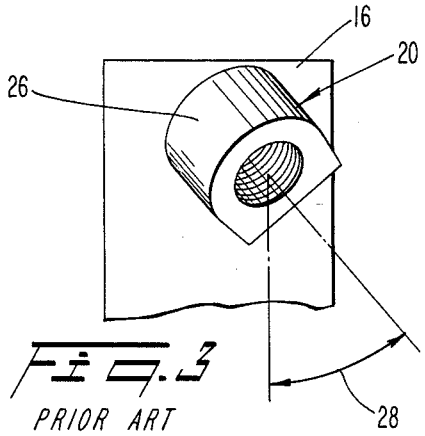
Fig. 3
PRIOR ART
Fig. 4
PRIOR ART
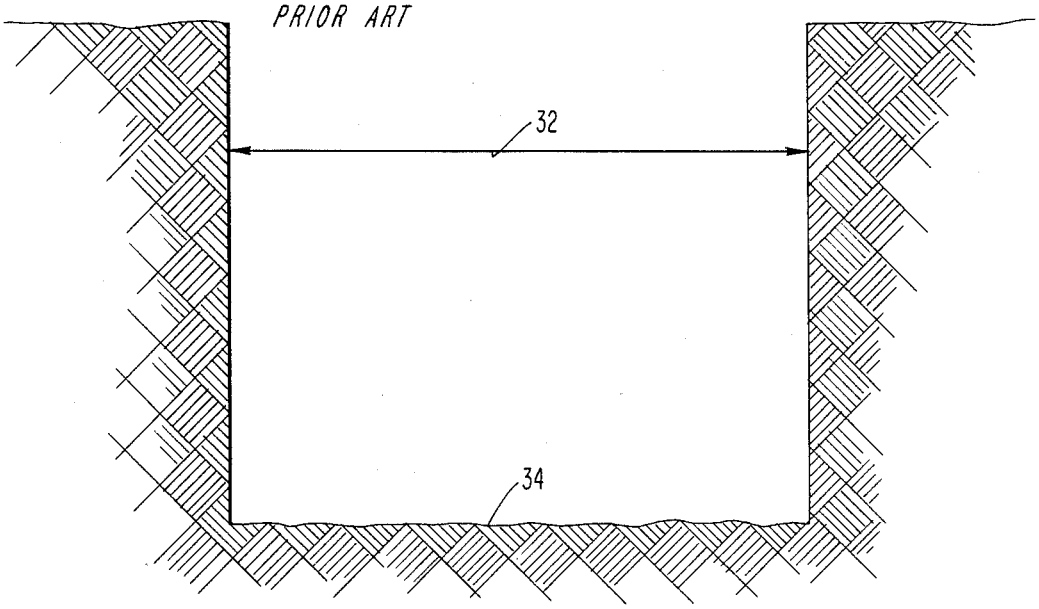

ROTARY ROCKSAW DEVICE

BACKGROUND OF THE INVENTION

1. Field of the Invention

This invention relates to a rocksaw device, and more particularly to a rocksaw disk capable of cutting a trench through hard rock on rocky soils.

The use of rocksaws in the art of trenching through hard rock and rocky soils has become practical through the introduction of the tungsten-carbide-insert tipped tooth held in a hardened steel socket at an angle to the direction of a cutting motion providing drag on the tooth point having an off-center component which induces rotation of the tooth in the socket.

This system is used in mining of relatively soft rocks, road planing, trenching, and sawing of hard rock.

The system requires tooth rotation to distribute wear evenly around the tooth point, keeping it sharp while at the same time dissipating the extreme heat generated by the friction between the rock and the carbide tip by rotating the heated tip portion out of the rock contact zone and providing a cooler tip portion in its place.

2. Description of the Prior Art

Conventional trenching devices comprise a driven disc or wheel on which tooth supporting segments are mounted. Each segment generally only covers a portion of the outer edge of the disc, e.g. ⅛ or 1/10, and a plurality of the segments are fastened to the disc to provide teeth around the entire periphery of the disc. A conventional mounting segment includes a base in the shape of a section of a toroid generated by a rectangle rotated around the disc axis. The base has radially inner and outer cylindrical section surfaces. The mounting segment also includes two segment mounting elements each having a plurality of holes therethrough for receiving bolts to attach the mounting segment to the disc. The base is attached to the segment mounting elements at its radially inner surface. The radially outer surface of the base is a mounting surface on which a plurality of tooth assemblies are mounted. The tooth assemblies are arranged in one or more patterns on each segment to provide teeth across a desired cutting width. Because the mounting surface is flat across its width in a direction parallel to the axis of the disc, the trench formed by the rocksaw also has a flat surface across the cutting width.

Each of the tooth assemblies comprises a tooth having a cylindrical shape with a central axis therethrough and a tungsten-carbide-insert tip at one end. A block having a bottom surface with a center line is welded to the segment base and rotatably supports the tooth at a constant rake angle defined between a line through the axis of the tooth and a line formed by the intersection of a first plane tangent to the segment base at the point where the block is attached and a second plane perpendicular to the first plane and including the line through the tooth's central axis.

The tooth blocks are arranged on each segment in a pattern to provide a desired cutting path during operation. The minimum cutting width of a cutting segment is set by the combined thickness of the disc plus the thickness of the segments bolted to it, the projection of fasteners, some extra width providing clearance from the trench side wall, and allowance for the shortening of cutter teeth through wear. In order to provide cutter teeth across the entire minimum width, the tooth blocks must be positioned somewhat crosswise to allow side clearance for the tooth assemblies and the disc and segment structure. This is accomplished by slanting and rolling the tooth assemblies on the mounting surface to provide side clearance of the tooth tip. Slanting comprises positioning a tooth block on the mounting surface to provide a slant angle, between the centerline of the bottom surface of the tooth block and a line tangent to the base at the point where the block is mounted to the base. Some slant is essential to induce rotation in the tooth tip. As discussed above, this distributes wear evenly around the tip and keeps the tip sharp. However, is the slant angle of a tooth is increased toward 90°, the advantage gained by side clearance of the tooth is obviated by problems such as severe side loading, overstressed welds, and broken tooth shanks.

Block roll is also employed to provide side clearance of the tooth tips. Roll is accomplished by welding a tooth block to the mounting surface at an angle defined by the intersection of a plane including the bottom surface of the tooth block and a plane tangent to the mounting surface at the point where the block is mounted on the surface. The use of roll increases the movement of the tooth tip to the side of the segment while reducing the top clearance of the tip. However, specialized welding is required to properly attach the block with a desired roll, thus, additional construction steps and specialized welding are necessary.

Any time either slant or roll, other than the slight amount of slant necessary for tooth rotation, is added to the tooth's designed in attack angle, it increases that angle and creates problems such as overstressed welds and broken tooth shanks. These problems are magnified when the speed of the disc and the power of the disc drive are increased to trench through hard rock and rocky soil.

Conventionally, segments have been crowded with teeth to minimize tooth breakage. The concept has been that by reducing the bite taken by each tooth, the strength of the rock would be overcome by the total strength of the teeth. However, increasing the number of teeth increases the forward force required to penetrate into the rock face being cut. Absent this increased forward force, penetration of the teeth drops and friction increases. This friction appears as heat at the interface between the tip and the rock. Since there is no shattering and removal of rock, the heat is retained in the contact zone and builds up with each passing tooth. This can result in excessive heat build up at the carbide tip causing softening of the cobalt matrix in which the carbide material is sintered. This, in turn, causes a radical reduction in the hardness and wear resistance of the tip. Therefore, it can be understood that crowding can be counter productive due to the decrease in the volume of material removed by a device delivering a constant forward force to the cutter teeth.

Another concern in conventional trenching device design is to balance the wear rate of the teeth across the width of the cutting segment.

The conventional trenching device cuts a trench having an essentially flat bottom and roughly square corners. The teeth positioned near the center of the cutting width have roughly 180° of rock resisting chip formation while the teeth at the edges of the cutting width have about 270° of rock structure applying resistance. This results in accelerated wear and breakage of the outer teeth. When this effect is combined with the above-mentioned effect of slant and roll of the outer segment teeth, the wear and breakage of these outer teeth is worse than the 180° to 270° rock resistance ratio would suggest.

The practice commonly followed to minimize uneven wear between the laterally outer and inner segment teeth has been to crowd the edges of the cutting width with additional tooth assemblies. As discussed above, crowding suffers from a counter productive trade off of balanced wear for cutter production. In addition, the use of extra tooth assemblies increases the cost of the device.

As can be understood, conventional trenching devices suffer from uneven wear of segment teeth across the cutting width and breakage of tooth and block welds. These problems are magnified when the device is used to cut hard rock or when the speed and horsepower of the device is increased.

It is desired to provide a device which minimizes these problems in a rocksaw capable of use in hard rock and rocky soil with high disc speeds and powers.

OBJECTS AND SUMMARY OF THE INVENTION

It is an object of the present invention to provide a rocksaw device capable of being used with increased cutting speeds and powers while maintaining increased resistance to wear and fracture of cutter teeth.

It is a further object to provide a device for cutting trenches, slots, and manholes through hard rock and rocky soils.

Yet another object of the present invention is to provide a rocksaw cutting segment which promotes even wear of teeth across the cutting width of the segment.

It is still another object of the present invention to provide one basic mounting structure design for a wide range of saw widths.

A further object of the present invention is to provide a mounting base which requires no specialized welding of tooth blocks on the mounting surface.

A still further object of the present invention is to provide a rocksaw device in which side lean of the cutting teeth is achieved by positioning tooth assemblies across a convex mounting surface.

In general, a rocksaw device according to the present invention employs a machine for driving a rocksaw disc in a rotary cutting operation. The rocksaw disc has an outer circumferential edge around which is mounted at least one mounting base. The at least one base is forced in the shape of a section of a toroid generated by a planar closed curve rotated around the disc axis. The planar closed curve which generates the toroid is curved along a side opposite the disc axis to provide a convex mounting surface across the mounting surface width parallel to the disc exit. Tooth assemblies are mounted on this convex mounting surface at a slant angle which induces rotation of the tooth in the block but does not subject the teeth to excessive contact pressures. The side clearance of the teeth on the base is provided by the combination of the slant angle, the built in rake angle and the curvature of the convex mounting surface across the mounting surface width. There is no need to slant the teeth on the mounting surface at an angle greater than a beneficial minimum slant angle or to roll the teeth with respect to the convex mounting surface since the curvature of the convex mounting surface provides all of the necessary side clearance to the cutting teeth positioned at the outer edges thereof. The teeth, therefore, cover a cutting width at least equal to the mounting surface width.

More specifically, the invention comprises a mounting base made up of at least one base section. Each base section is in the shape of a section of a torus generated by a circle rotated about the disc axis. The surface of the base is a convex mounting surface on which tooth assemblies are mounted. Each of the tooth assemblies are designed to provide the tooth at a built-in rake angle and can be additionally provided with a groove along the bottom surface of the block at an angle to either side of the center line of the block base equal to a desired constant minimum slant angle. This allows easy positioning and welding of each of the tooth assemblies on the mounting surface and ensures that all of the tooth assemblies are positioned at the same desired slant angle. Alternately, flat bottomed tooth blocks can be positioned and welded onto the mounting surface to provide all of the tooth assemblies at the same slant angle.

Each tooth block can be positioned on the base such that the tip of the tooth supported therein is located a certain distance from a central plane perpendicular to the disc axis and passing through the center of the mounting surface width. This distance is dependant on the rake angle and slant angle of the tooth, as well as the degree of curvature across the convex mounting surface. Therefore, the location of the tooth block across the convex mounting surface determines the distance that the tooth tip is located from the central plane. In this way the cutting width can be established without the need for excessive slant angles and roll of the teeth on the mounting surface simply by appropriately positioning the tooth assemblies across the convex mounting surface.

In one specific form of the invention, tooth assemblies are arranged on a first base section to provide the tips at a first set of distances from the central plane and tooth assemblies are arranged on a second section or along a second portion of the one base section to provide the tips at a second set of distances from the central plane. None of the first set of distances are the same as any of the second set of distances. This design results in increased productivity by providing the teeth of alternate segments at a previously untracked rock interface. This, in turn, promotes chip formation.

BRIEF DESCRIPTION OF THE DRAWING

The prior art and the preferred embodiment of the invention are discussed in the following detailed description which should be considered in connection with the figures in the accompanying drawing, in which:

FIG. 1 is a front elevation of a tooth and mounting segment of the prior art;

FIG. 2 is a front elevation of a tooth and mounting segment of the prior art including a roll angle;

FIG. 3 is a plan of a tooth and mounting segment of the prior art including a skew angle;

FIG. 4 is a front elevation of a trench formed by a prior art device showing the tracks formed by the teeth of the prior art device;

DETAILED DESCRIPTION OF THE PREFERRED EMBODIMENT

Figure 5:
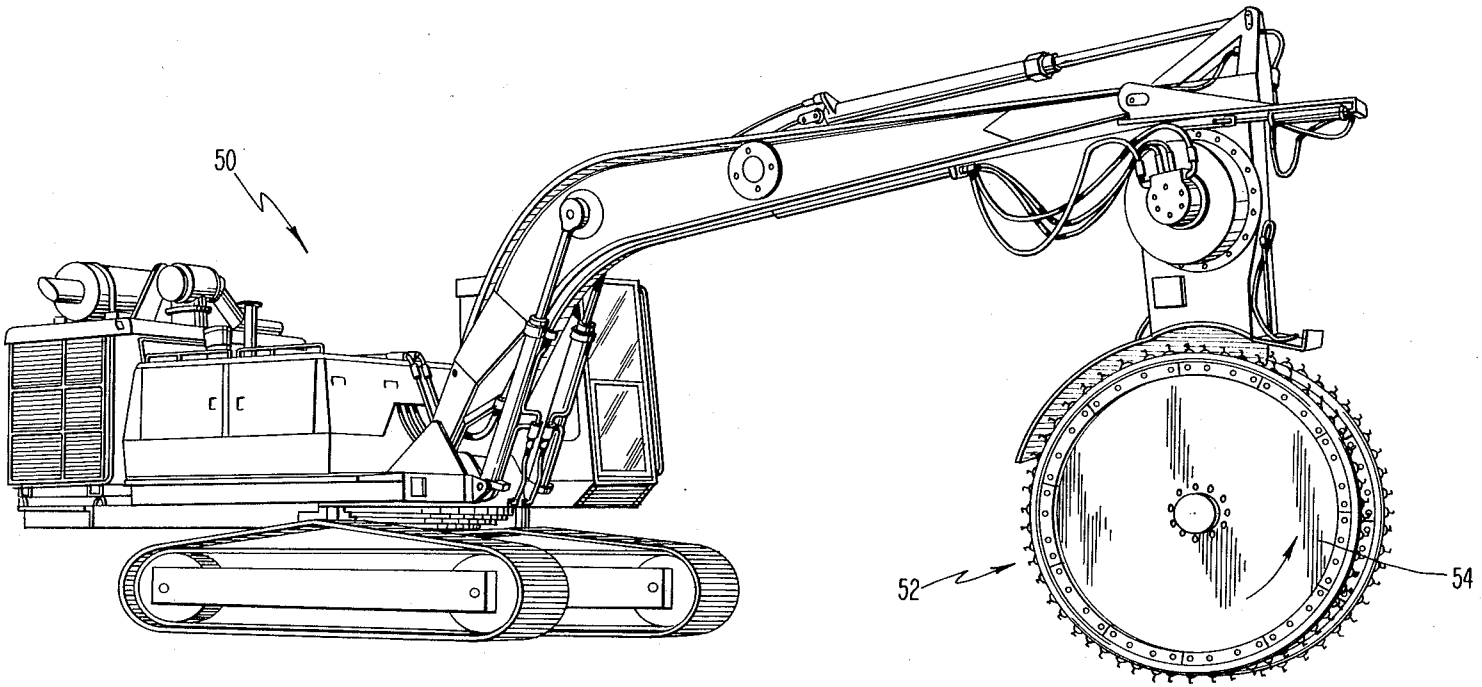
FIG. 5 is a perspective view of a machine employing the rocksaw device of the present invention.

A prior art device and a trench formed by such a prior art device are shown in FIGS. 1–4 of the drawing. Specifically, the prior art of FIG. 1, comprises a rocksaw wheel or disc 12 having a circumferential edge at which a segment is mounted. The segment 14 includes mounting elements and a mounting base 16. The base 16 is formed in the shape of a section of a toroid generated by a rectangle rotated about the disc axis. The base has a radially outer cylindrical section surface 18 which serves as a mounting surface. This mounting surface is flat across the mounting surface width extending in a direction parallel to the disc axis. Tooth assemblies, e.g., 20, are mounted on the flat mounting surface 18 at various roll and slant angles and in various arrangements which establish the cutting width of the segment 14 and provide for side clearance of the teeth fast the edges of the mounting surface.

In FIG. 2, the roll angle 22 of a tooth assembly mounted on a segment of a prior art device is defined by the intersection of a plane including the bottom surface 24 of the tooth block 26 and a plane tangent to the mounting surface at the place where the tooth assembly is mounted thereon.

The slant angle 28 of the prior art device shown in FIG. 3, is defined between the center line of the bottom surface of the tooth block 26 and a line tangent to the base 16 at the point where the block 26 is mounted on the base 16.

A trench formed during the operation of a prior art device of the type discussed herein, is shown in FIG. 4. The trench is flat across the cutting width 32 and has substantially square corners between the trench cutting surface 34 and the side walls of the trench.

The present invention will now be discussed with respect to FIGS. 5–12.

A machine employing the rocksaw device of the present invention is shown in FIG. 5. The machine 50 supports a rotary rocksaw 52 at a central axis of the rocksaw disc 54 and provides a counter clockwise rotational drive to the disc as shown in FIG. 6.

Figure 6A:
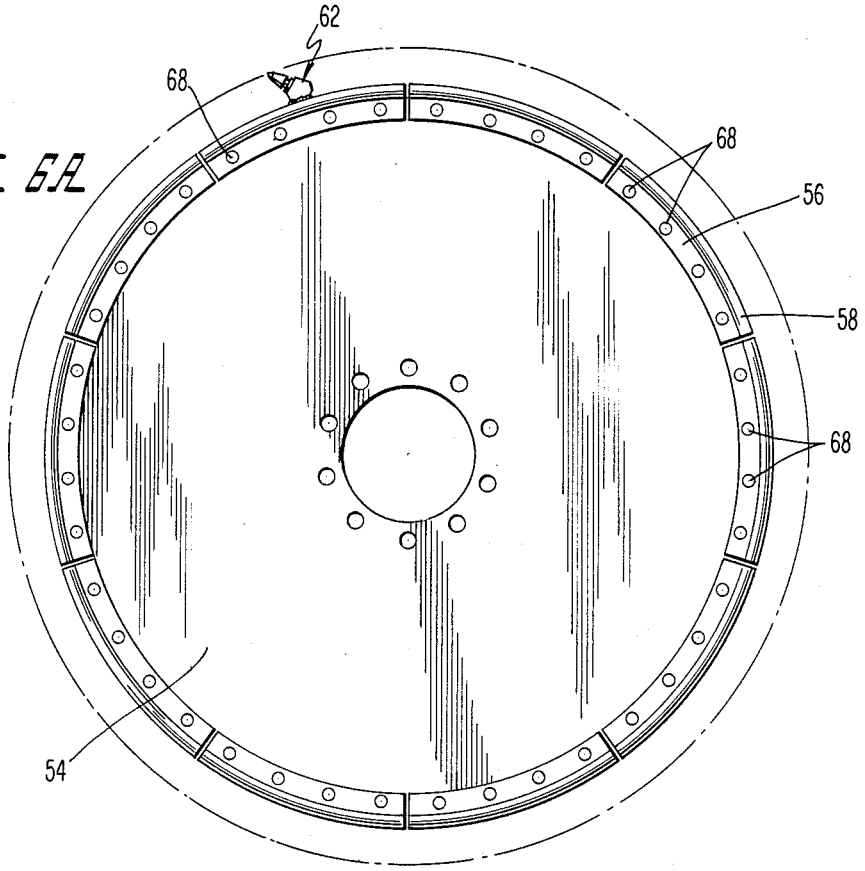
FIG. 6*a* is a side elevation of the rocksaw device of the present invention illustrating a first mounting base arrangement.
Figure 6B:
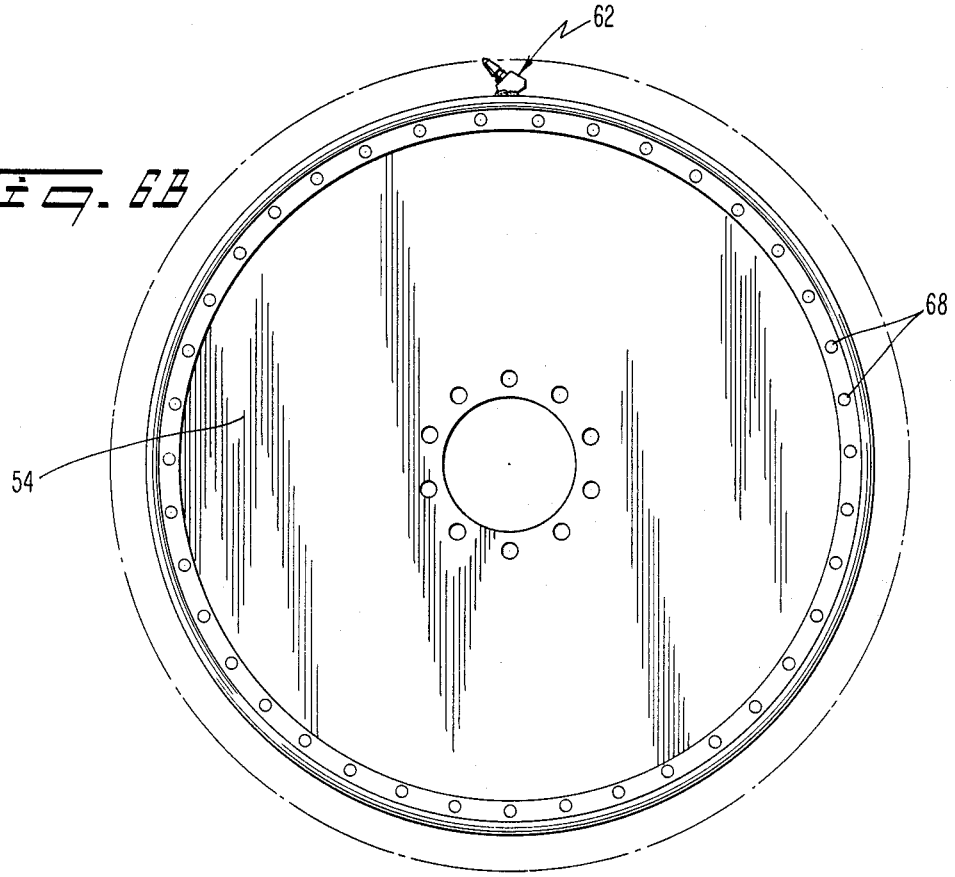
FIG. 6*b* is a side elevation of the rocksaw device of the present invention illustrating a second mounting base arrangement.

The rocksaw disc 54 of the present invention is shown in FIGS. 6*a* and 6*b*. The disc of FIG. 6*a* comprises a disc 53 having a circumferential edge and a mounting base 57 welded to the disc around its circumferential edge. The mounting base 57 can either be made of one piece of material having a length sufficient to extend around the entire circumferential edge of the disc or may include a number of base sections welded around the disc edge.

the mounting base 57, or each base section is formed in the shape of a section of a toroid generated by a planer closed curve rotated around the disc axis. The planer closed curve which generates the toroid is curved along a side opposite the disc axis to provide a convex mounting surface across its width parallel to the disc axis. For example, the cross-sectional shape of the base 57 may be circular.

Figure 7:
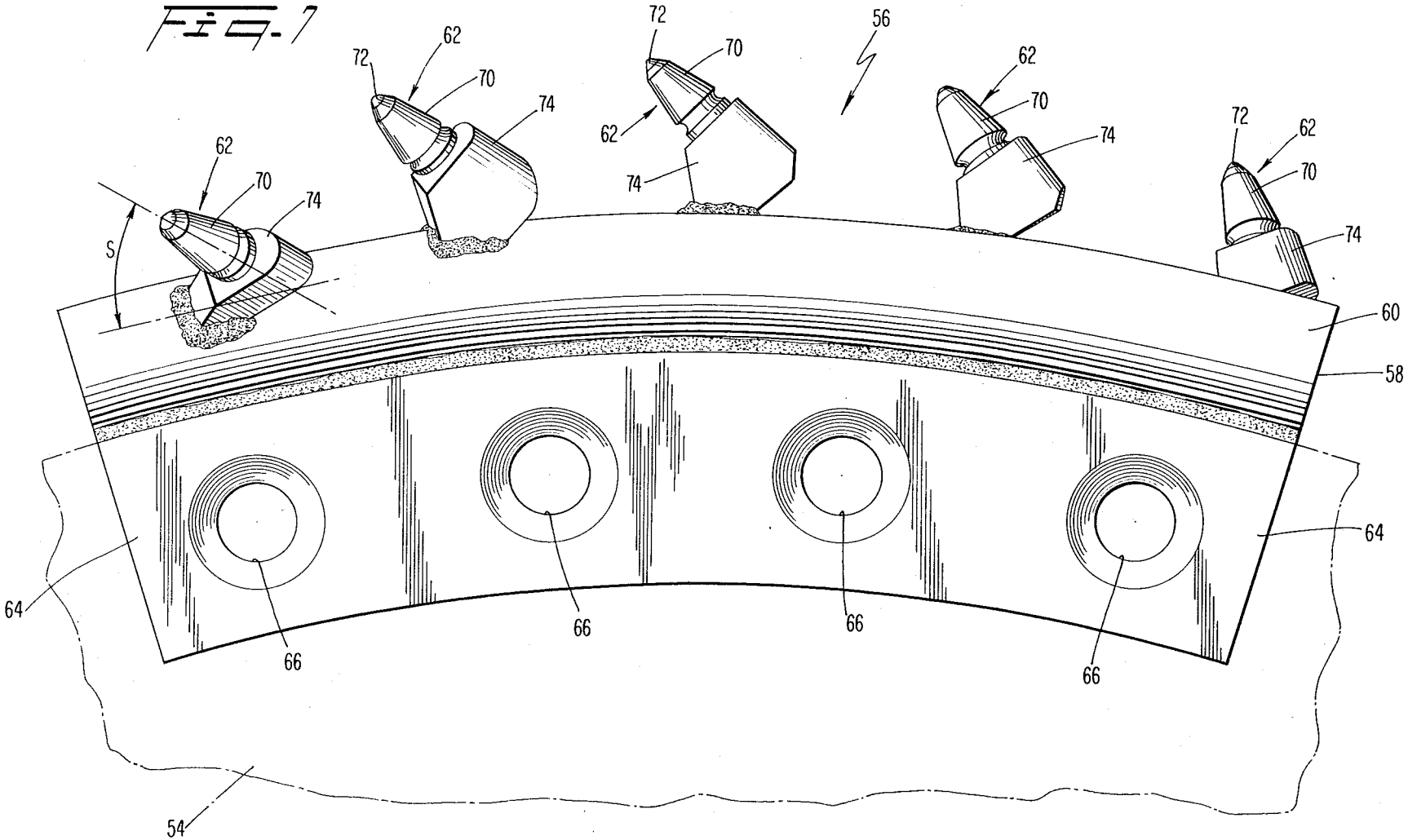
FIG. 7 is a side elevation of one segment mountable on the rim of a disc of the invention.
Figure 8:
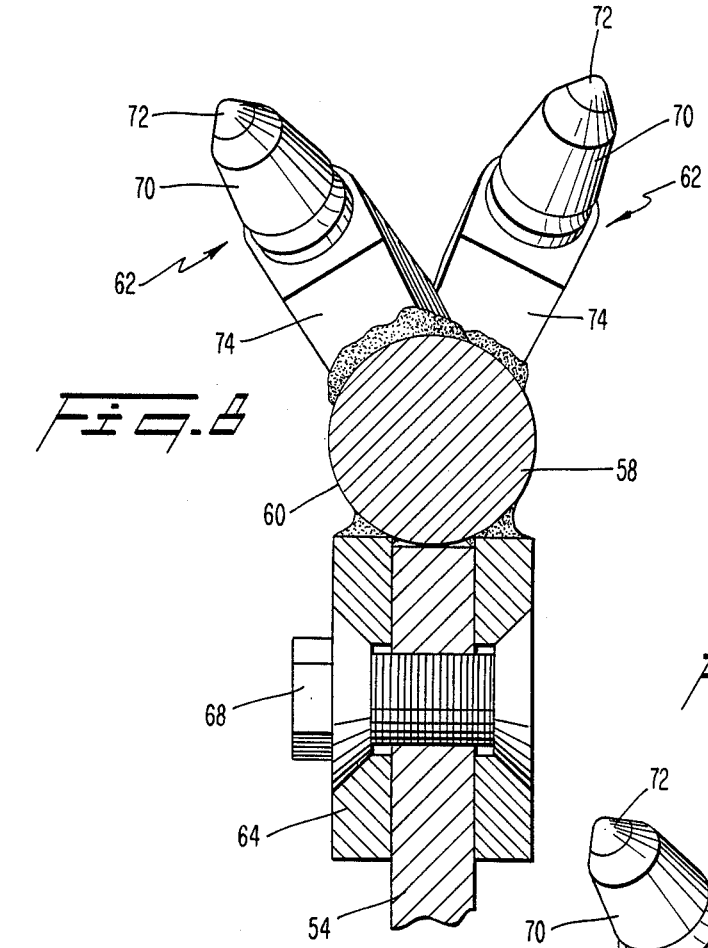
FIG. 8 is a front elevation of a tooth and a mounting segment of the present invention.

An arrangement by which base sections 58 can be bolted to a disc 54 is shown in FIG. 6*b*. The base sections 58 are similar to the base 57 of FIG. 6*a* and it will be understood that the following discussion relating to the base section 58 shown in FIG. 6*b* is also applicable to the base 57 in the arrangement of FIG. 6*a*. In this second arrangement, a number of mounting segment 56, preferably eight or ten, are fastened along the edge and cover the circumference of the disc unit 54. The segments 56 have base sections 58 mounted at radially outer sides thereof. As shown in FIGS. 7 and 8 each of these base sections 58 is again formed in the shape of a section of a toroid generated by a planar closed curve rotated around the disc axis. The planar closed curve which generates the toroid is curved along a side opposite the disc axis to provide a convex mounting surface across its width parallel to the disc axis.

The convex mounting surface supports a plurality of tooth assemblies at different positions along its length and at different locations across its width. The teeth define a cutting width which is at least equal to the mounting surface width and the tips of all of the teeth are located at a constant radial distance from the convex mounting surface.

This positioning of the tooth assemblies generates a curved trench bottom and provides side clearance sufficient to permit subsequent segments to pass therethrough. This side clearance is achieved without slanting the tooth assemblies on the base past a minimum beneficial slant angle or rolling the tooth assemblies with respect to the convex mounting surface. Therefore, the chance for the teeth to quickly wear out or break may be reduced to a minimum.

Figure 9:
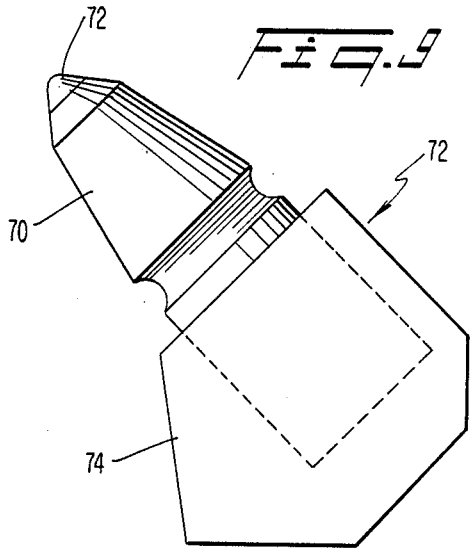
FIG. 9 is a side elevation of a tooth and mounting segment of the prior art including a rake angle.
Figure 10:
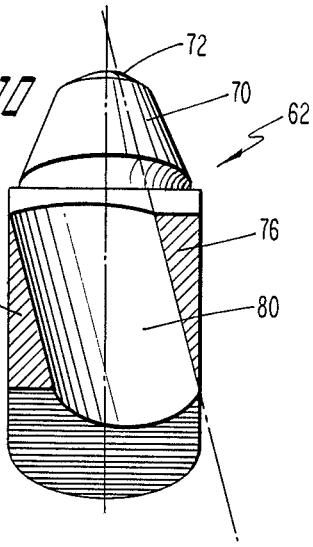
FIG. 10 is a bottom elevation of a preferred tooth block of the present invention.
Figure 10A:
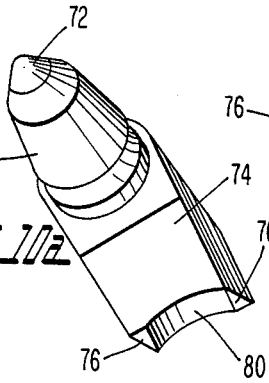
FIG. 10*a* is a perspective view of the preferred tooth block of the present invention.

The details of one segment 56 are illustrated in FIGS. 8 and 9. The segment 56 is provided with two segment mounting elements 64 formed to fit on either side of the rocksaw disc unit. Holes 66 are provided in the elements 64 for guiding bolts 68 used to fasten the segment 56 to the disc 54. The base section 58 is fastened to the mounting elements 56, for example, by welding. As mentioned, the base section 58 is preferably formed in the shape of a section of a torus generated by a circle rotated about the disc axis.

The surface 60 of the base section opposite the disc axis serves as the convex mounting surface onto which tooth assemblies 62 are mounted. The cutting width of the rocksaw is partially determined by the size of the base section 58 employed. For example, if a large cutting width is desired, a base section having a large diameter mounting surface is employed such that the tooth assemblies mounted thereon cover a wider cutting width. If a small cutting width is desired a small diameter mounting surface is employed. Additionally, shorter teeth may be employed to further reduce the minimum cutting width. It can be understood that the same segment design can be used to generate varying cutting widths.

A tooth assembly 62 welded to the convex mounting surface 60 comprises a cylindrical tooth body 70 having a tungsten-carbine-insert tip 72 at one end. The tooth is rotatably supported in a tooth mounting clock 74 at the other end. A central axis passes through the center of the tooth body 70 and tip 72. The tooth mounting block 74 is provided with a hole for positioning the tooth body and has a bottom surface 76 shown in FIG. 10, which contacts the base mounting surface 60 then the tooth assembly 62 is welded to the base section 58. A center line passes along the bottom surface 76 in a plane perpendicular to the bottom surface containing the axis of the tooth.

The axis of the tooth forms a rake angle 77 with the bottom surface 76 of the block 74 defined between the axis of the tooth and the center line of the bottom surface 76 of the block 74.

In order to induce rotation of the tooth tip 72 in the mounting block 74 during operation, the tooth assembly 62 is mounted on the base section 58 at an angle referred to as a slant angle which is defined by the intersection of the center line of the bottom surface 76 of the tooth block 74 and a line perpendicular to the disc axis and tangent to the base section 58 at the point where the block 74 is mounted on the base section 58.

A preferred slant angle is 15° for most commercially available tooth blocks having a built in rake angle of 45°. It is of course understood that this is a preferred slant angle and that other slant angles may be proper so long as they provide an offset drag on the tooth which induces rotation of the tooth in the block and do not expose the tooth to an excessive angle which would result in increased breakage of the tooth or the block weld.

Once a desired slant angle 79 has been established, all of the tooth assemblies 62 mounted on the rocksaw device 52 can be positioned at that optimum slant angle. Therefore, all of the tooth assemblies 62 mounted on the rocksaw disk 54 of the present invention have the same rake angles and slant angles. This enables easy construction of the mounting segments 56 since special positioning and welding is not required.

The construction of the segments 56 can be further facilitated by providing the bottom surfaces of the mounting blocks with grooves 80 defining the desired slant angle 79. Each groove 80 runs along the bottom surface 76 of the mounting block 74 at an angle to the center line of the bottom surface 76 equal to the slant angle 79. Accordingly, when the block 74 is placed at a mounting location on the base section 58, the groove 80 positions the tooth assembly 62 at the predetermined slant angle 79 and provides intimate surface contact between the bottom surface 76 of the block and the mounting surface 60 of the base section 58.

Figure 11:
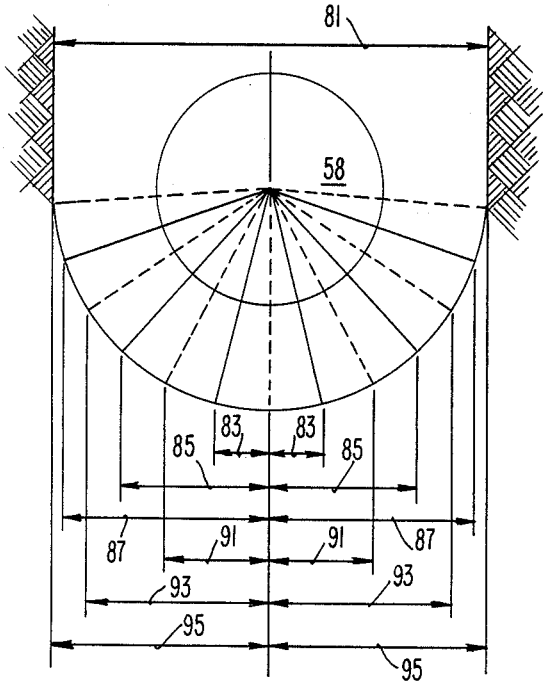
FIG. 11 is a front elevation of a trench formed by the present invention showing the effect of the staggered teeth feature of the present invention.

As illustrated in FIG. 11, the cutting width 81 of a segment 56 is provided by positioning the tooth assemblies 62 on the convex mounting surface across the width of the base section 58. As is shown in FIG. 8, a tooth assembly 62 can be positioned on the base section 58 to provide the tip 72 of the tooth at any desired distance 83 from a central plane perpendicular to the disc axis and passing through the center of the mounting surface width. When a mounting assembly is removed away from the disc axis on the mounting surface the tip 72 moves further from the central plane and also moves radially inward with respect to the disc axis. This occurs because of the convexity of the mounting surface and results in a cutting width being defined which is curved across its width as shown in FIG. 11.

Figure 12:
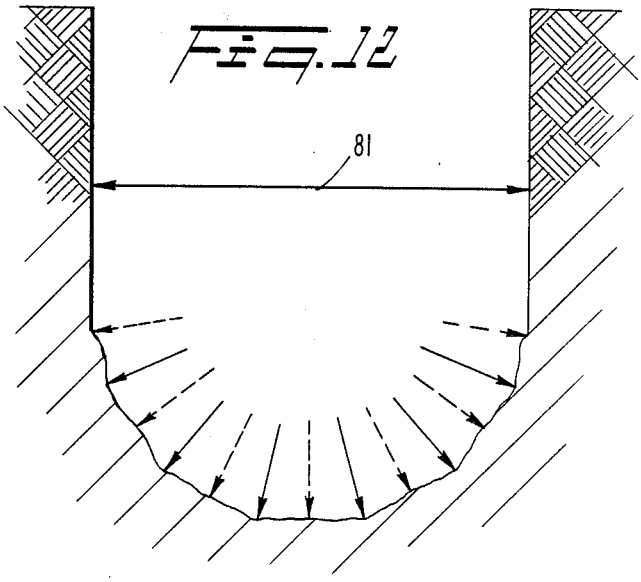
FIG. 12 is a front elevation of a trench formed by the present invention showing the tracks formed by the staggered teeth feature of the present invention.

The amount of curvature along the cutting width is directly dependant on the degree of curvature of the mounting surface of the base 58, the size of the teeth 70 employed, and the rake and slant angles 77 and 79 employed. As can be seen in FIG. 12, the teeth located near the center of the cutting width have more than 180° of rock resisting chip formation. The teeth at the outer edges of the cutting width meet with less than 270° of rock resistant to chip formation. Because of the reduced difference in the amount of resistance opposing the center teeth and the outer teeth, the teeth wear move evenly than teeth mounted on a flat mounting base having a flat width. In addition, since all of the teeth are provided at an optimum slant angle the breakage of teeth at the outer edges of the cutting width is minimized.

Where a very narrow cutting width is desired, tooth assemblies 62 may be positioned along only a narrow outer portion of the mounting surface 60 such that the cutting width is only slightly greater than the mounting surface width. The cutting width formed by this construction has less curvature than the normal cutting width formed by positioning tooth assemblies across the major portion of the mounting surface and, therefore, corners are present in the trench at the edges of the trench cutting surface. In these circumstances, some crowding of tooth assemblies 62 at the outer edges of the convex mounting surface may be necessary to distribute wear over more teeth at the outer edges of the cutting interface.

Although this results in certain disadvantages, the construction still provides the benefit of some cutting width curvature and, therefore, the difference in the amount of resistance opposing the center teeth and the outer teeth is reduced somewhat thus helping to balance the wear of the teeth across the cutting width.

The segments 56 of the preferred rocksaw can be arranged on the disk 54 to provide alternate segments along the circumference with different tooth arrangements. Tooth assemblies are mounted on a first segment to provide the tips of the teeth at a first set of distances 83, 85, 87 from the central plane defined above. For example, a first tooth assembly may be mounted directly in the central plane to provide its tip at a distance 83 from the central plane. A second tooth assembly can be mounted axially along the segment on the same line as the first tooth assembly but at a slant angle 79 equal and opposite to the first tooth assembly so that the tip of the second tooth is located at the distance 83 on the opposite side of the central plane. Additional tooth assemblies can be mounted axially along the base at different locations across the convex mounting surface to provide the tips of the teeth at greater distances, e.g., 85, 87 from the central plane.

Tooth assemblies are mounted on a second segment to provide the tips of the teeth at a second set of distances 91, 93, 95 different from the first set of distances 83, 85, 87. For example, a first tooth assembly can be mounted to one side of the central plane to provide the tooth tip at the central plane. Because none of the tooth assemblies on the first segment were positioned in the same location as this tooth assembly on the second segment, the tooth tip contacts the rock at a previously untracked position. As can be seen in FIG. 11, this encourages chip formation by presenting less rock to resist such formation at the tip. In addition, heat stored in the cutting track of a first tip, which is generated by the contact of the first cutting tip with the rock at the cutting interface, is not passed on to the tip of the second segment because the second segment tip does not follow in the same track.

The rocksaw device discussed herein is capable of use with machines supplying increased horsepower and speed to the rocksaw disc while maintaining a minimum amount of tooth breakage and wear. In addition, because all of the teeth operate at the same slant angle and contact roughly the same amount of rock, wear occurs evenly in teeth across the cutting width of the segments.

It is of course possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

What is claimed is:

1. A rocksaw device for trenching through hard rock and rocky soil comprising:

a disc unit rotatable about a central axis and having an outer circumferential edge;

drive means to rotate said disc means;

a mounting base positioned along at least a portion of said circumferential edge, said mounting base being in the shape of a section of a toroid generated by a planar closed curve rotated around said central axis, said closed curve being curved along a side opposite said central axis to provide a convex mounting surface across a mounting surface width extending in a direction parallel to said central axis; and a plurality of tooth assemblies each having a tooth with a tip and being mounted on said convex mounting surface at different positions along said convex mounting surface and at different locations across said mounting surface width, said tips defining a cutting width which is at least equal to said mounting surface width, and said tips being located at a constant radial distance from said convex mounting surface.

2. The rocksaw device according to claim 1, wherein said closed curve has a constant degree of curvature along said side opposite said central axis to provide said convex mounting surface with a circular section curve across said mounting surface width.

3. The rocksaw device according to claim 1, wherein said closed curve is a circle.

4. The rocksaw device according to claim 1, wherein each of said tooth assemblies has a tooth axis passing through said tip and a block having a bottom surface, said block supporting said tooth at a predetermined rake angle defined between a line through said tooth axis and a line formed by the intersection of a first plane which includes said bottom surface of said block and a second plane perpendicular to said first plane which includes said line through said tooth axis, said rake angle of all of said teeth being equal.

5. The rocksaw device according to claim 1, wherein each of said teeth has a tooth axis passing through said tip and a block having a bottom surface provided with a center line, each of said tooth assemblies being mounted on said convex mounting surface at a predetermined slant angle defined between the center line of said bottom surface of said block and a line perpendicular to said central axis and tangent to said base at a point where said block is attached to said base, said slant angle being the same for all tooth assemblies mounted on said disc.

6. The rocksaw device according to claim 5, wherein said bottom surface bears against said convex mounting surface when the tooth assembly is mounted on said base and is formed with a groove therein at an angle to said center line of said bottom surface, said angle being equal to said predetermined slant angle such that the tooth assembly can be positioned on said base at said predetermined slant angle by permitting said groove to mate with said convex mounting surface when the tooth assembly is placed against the base for mounting.

7. The rocksaw device according to claim 5, further comprising:

a plurality of said mounting bases around said edge, each of said tooth assemblies being mounted at a position across said convex mounting surface to provide the tip thereof at a distance from a central plane perpendicular to said central axis and passing through the center of said mounting surface width, said distance being determined by said mounting position of each of the tooth assemblies across said convex mounting surface, the tooth assemblies of a first of said bases being positioned on said convex mounting surface such that the tips of said tooth assemblies are provided at a first set of distances from said central plane, the tooth assemblies of a second of said bases being positioned on said convex mounting surface such that the tips of said tooth assemblies are provided at a second set of distances from said central plane, none of the distances of said second yet being equal to any of the distances of said first set.

8. A rocksaw mounting segment for use in a rotary rocksaw, comprising:

segment mounting means to mount said mounting segment on the rocksaw;

a base section attached to said segment mounting means, said base section having a shape of a section of a toroid generated by a planar closed curve rotated about an axis line, said closed curve being curved along a side opposite said axis line to provide a convex mounting surface across a mounting surface width extending in a direction parallel to said axis first line; and a plurality of tooth assemblies each having a tip and being mounted on said convex mounting surface at different positions along said convex mounting surface and at different locations across said mounting surface width, said tips defining a cutting width which is at least equal to said mounting surface width, said tips of all of said teeth being located at a constant radial distance from said convex mounting surface.

9. A rocksaw mounting segment according to claim 8, therein said planar closed curve has a constant degree of curvature along said side opposite said axis line to provide a mounting surface with a circular section curve across said mounting surface width.

10. The rocksaw mounting segment according to claim 8, wherein said closed curve is a circle.

11. The rocksaw mounting segment according to claim 8, wherein each of said tooth assemblies has a tooth axis passing through said tip, and a block having a bottom surface, said block supporting said tip at a predetermined rake angle defined between a line through said tooth axis and a line formed by the intersection of a first plane which includes said bottom surface of said block and a second plane perpendicular to said first plane which includes said line through said tooth axis, said rake angles of all of said tooth assemblies being equal.

12. The rocksaw mounting segment according to claim 8, wherein each of said tooth assemblies has a tooth axis and a block having a bottom surface provided with a center line, each of said tooth assemblies being mounted on said convex mounting surface at a predetermined slant angle defined between the center line of said bottom surface of said block and a line perpendicular to said axis line and tangent to said base section at a point where said block is attached to said base, said slant angle being the same for all tooth assemblies mounted on said base.

13. The rocksaw mounting segment according to claim 12, wherein said bottom surface bears against said convex mounting surface when the tooth assembly is mounted on said base section and is formed with a groove therein at an angle to said center line of said bottom surface, said angle being equal to said predetermined slant angle such that the tooth assembly can be positioned on said base at said predetermined slant angle by permitting said groove to mate with said convex mounting surface when the tooth assembly is placed against the base section for mounting.

14. The rocksaw mounting segment according to claim 12, further comprising:

a second mounting segment, a plurality of tooth assemblies being mounted at positions across the convex mounting surfaces of the segments to provide the tips thereof at distances from a central plane perpendicular to said axis line which passes through the center of said mounting surface width, said distances being determined by said mounting position of each of the tooth assemblies across said convex mounting surfaces, the tooth assemblies of a first of said segments being positioned on said convex mounting surface of that segment such that the tips of said tooth assemblies are provided at a first set of distances from said central plane, the tooth assemblies of said second segment being positioned on said convex mounting surface of that segment such that the tips of said tooth assemblies are provided at a second set of distances from said central plane, none of the distances of said second set being equal to any of the distances of said first set.

15. A tooth block capable of being mounted on a convex mounting surface of a rocksaw comprising:

a bottom surface which bears against the convex mounting surface of the rocksaw when said block is mounted on the rocksaw;

a front side having an opening therein for receiving a tooth; and a rear side opposite said front side;

said bottom surface having a center line extending between said front side and said rear side and being formed with a groove therein at an angle to said center line of said bottom surface such that the block can be positioned to mate with the convex mounting surface when the block is placed against the convex mounting surface for mounting, said angle being adapted to define a slant angle of the tooth receivable in the front side of said tooth block.

16. The tooth block according to claim 15, wherein said groove is formed at an angle of about 15° to said center line.

* * * * *